US007731572B2

(12) United States Patent
Yu et al.

(10) Patent No.: US 7,731,572 B2
(45) Date of Patent: Jun. 8, 2010

(54) CMP HEAD

(75) Inventors: Chi-Min Yu, Hsinchu (TW); Chi-Chih Chuang, Hsinchu (TW); Yu-Fang Chien, Taipei County (TW); Hui-Shen Shih, Chang-Hua Hsien (TW)

(73) Assignee: United Microelectronics Corp., Hsin-Chu (TW)

( * ) Notice: Subject to any disclaimer, the term of this patent is extended or adjusted under 35 U.S.C. 154(b) by 181 days.

(21) Appl. No.: 11/752,928

(22) Filed: May 24, 2007

(65) Prior Publication Data

US 2008/0293342 A1 Nov. 27, 2008

(51) Int. Cl.
*B24B 5/00* (2006.01)

(52) U.S. Cl. ..... 451/398; 451/397; 451/285

(58) Field of Classification Search ..... 451/285, 451/287, 288, 289, 290, 398, 402
See application file for complete search history.

(56) References Cited

U.S. PATENT DOCUMENTS

| | | | | |
|---|---|---|---|---|
| 6,210,255 | B1 * | 4/2001 | Zuniga et al. | 451/41 |
| 6,514,124 | B1 * | 2/2003 | Zuniga et al. | 451/41 |
| 6,623,343 | B2 * | 9/2003 | Kajiwara et al. | 451/398 |
| 6,705,932 | B1 * | 3/2004 | Zuniga et al. | 451/397 |
| 6,716,084 | B2 * | 4/2004 | Basol et al. | 451/4 |
| 6,848,980 | B2 * | 2/2005 | Chen et al. | 451/285 |
| 6,893,332 | B2 * | 5/2005 | Castor | 451/288 |
| 7,160,179 | B2 * | 1/2007 | Custer et al. | 451/41 |
| 2008/0268753 | A1 * | 10/2008 | Ishikawa et al. | 451/36 |

FOREIGN PATENT DOCUMENTS

| | | | |
|---|---|---|---|
| EP | 1048407 | A2 | 11/2000 |
| JP | P2002367941 | A | 12/2002 |
| TW | 471997 | | 1/2002 |
| TW | 485089 | | 5/2002 |

* cited by examiner

*Primary Examiner*—Timothy V Eley
(74) *Attorney, Agent, or Firm*—Winston Hsu

(57) ABSTRACT

A CMP head includes a membrane support and a membrane. The membrane support is disk-shaped, having an origin and a radius R. The membrane support has at least a ventilator disposed in a central region within the range between origin and (⅔) R, and at least a diversion opening disposed in a peripheral region within the range between (⅔) R and R. The membrane includes a disk-shaped part disposed on the first surface of the membrane support, and an annular part surrounding the annular sidewall of the membrane support.

35 Claims, 20 Drawing Sheets

CMP HEAD

BACKGROUND OF THE INVENTION

1. Field of the Invention

The present invention relates to a CMP head and method of making the same, and more particularly, to a CMP head having diversion openings in the peripheral region and method of making the same.

2. Description of the Prior Art

Chemical mechanical polishing (CMP) is a planarization technique used to planarize the surface of integrated circuits formed on a semiconductor wafer so that high-density multi-layered interconnections can be formed on the planarized surface. Normally, CMP has been applied in the fabrication of inter-layer dielectric (ILD), plug, shallow trench isolation (STI), damascene structure, etc.

Please refer to FIG. 1. FIG. 1 is a schematic diagram of a conventional CMP apparatus. As shown in FIG. 1, the CMP apparatus includes a rotatable platen 10, a polish pad 12 bonded to the platen 20 and able to rotate with the platen 10, a slurry supply 14 for supplying slurry 16 to the polish pad 12, and a CMP head 20 used to fix a wafer 18.

During a CMP process, the wafer 18 is placed in between the CMP head 20 and the polish pad 12. The CMP head 20 brings pressure upon the wafer 18 and drives the wafer 18 to rotate so that mechanical polishing effect can be generated between the wafer 18 and the polish pad 12. Meanwhile, the material layer to be planarized of the wafer 18 reacts with the slurry 16, thereby generating chemical polishing effect.

Please refer to FIG. 2 as well as FIG. 1. FIG. 2 illustrates a conventional CMP head. As shown in FIG. 2, the conventional CMP head 20 includes a membrane 22 disposed on a wafer 18, a membrane support 24, a support pad 26 disposed between the membrane 22 and the membrane support 24, and a retaining ring 28 surrounding the membrane 22, the support pad 26, and the membrane support 24. The membrane support 24 includes ventilators 30 and the support pad 26 has corresponding holes 32 so that gas can pass there through.

Please refer to FIG. 3. FIG. 3 illustrates the conventional CMP head 20 during a CMP process. As shown in FIG. 3, gas is implanted into the CMP head 20 through the ventilator 30 of the membrane support 24 and the holes 32 of the support pad 26 during the CMP process. The flexible membrane 22 is pushed by the implanted gas and extends outwardly, thereby bringing pressure upon the wafer 18.

The goal of CMP is to planarize the material layer, but the uniformity of the material layer is critical to the yield of successive processes and the reliability of the devices to be formed. In a CMP process, the pressure that the CMP head 20 exerts upon the wafer 18 is crucial to the uniformity of the material layer.

In conventional CMP design, the ventilators 30 are formed in the central region of the membrane support 24, and the peripheral region does not have any openings. As a result, the collision frequency of gas is higher in certain areas in the peripheral region of the membrane 22, producing higher pressure (as region A shown in FIG. 3). As long as the pressure is unequal, the polishing rate is not equally distributed, and this leads to poor uniformity.

Please refer to FIG. 4. FIG. 4 illustrates a thickness distribution diagram of a material layer after CMP by using a conventional CMP head. In this experiment, the material layer is an oxide layer of 11,000 angstroms disposed on an 8-inch wafer, undergoing 60 seconds of CMP. As shown in FIG. 4, the thickness of the oxide layer in the central region is reduced from 11,000 to 7,300 angstroms, which shows a good uniformity in the central region. However, the thickness of the oxide layer in the peripheral region is evidently thinner (approximately ranging from 70 and 95 mm). This shows the polishing rate is higher in this region, and this over-polishing phenomenon (referred to as fast band effect) occurs to CMP processes frequently.

The fast band effect causes an unfavorable uniformity in the peripheral region, and affects the yield and reliability of the devices to be formed. Therefore, it is an important issue to prevent the occurrence of fast band effect in CMP.

SUMMARY OF THE INVENTION

It is therefore one of the objectives of the claimed invention to provide a CMP head to prevent fast band effect.

According to an embodiment of the present invention, a CMP head is provided. The CMP head includes a membrane support and a membrane. The membrane support is substantially disk-shaped having a first surface, a second surface, and an annular sidewall between the first surface and the second surface. The membrane support has at least a ventilator and at least a diversion opening, wherein the membrane support has an origin and a radius R, the membrane support has a central region within a round region between the origin and ⅔ R, and a peripheral region within a ring region between ⅔ R and R, the ventilator is disposed in the central region, and the diversion opening is disposed in the peripheral region.

The CMP head of the present invention uses diversion opening design to equalize the gas pressure implanted into the CMP head so that the thickness uniformity of CMP is improved.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
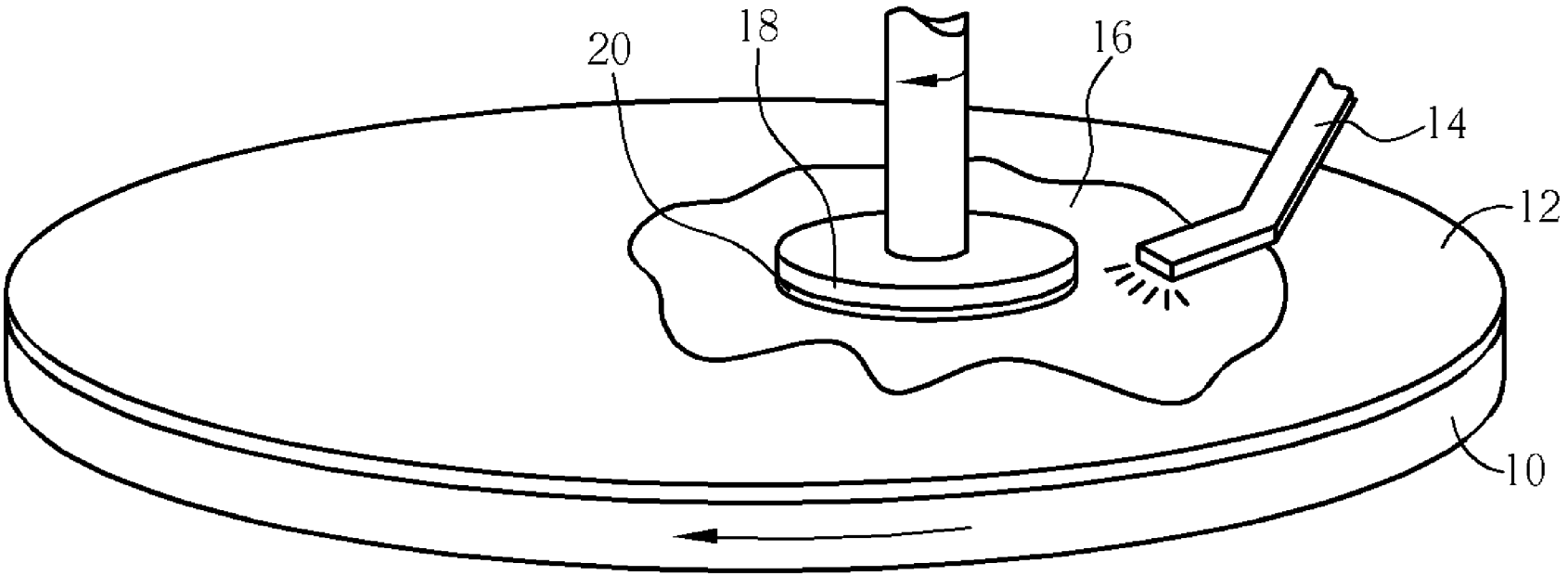
Fig. 1 Prior art
FIG. 1 is a schematic diagram of a conventional CMP apparatus.
Figure 2:
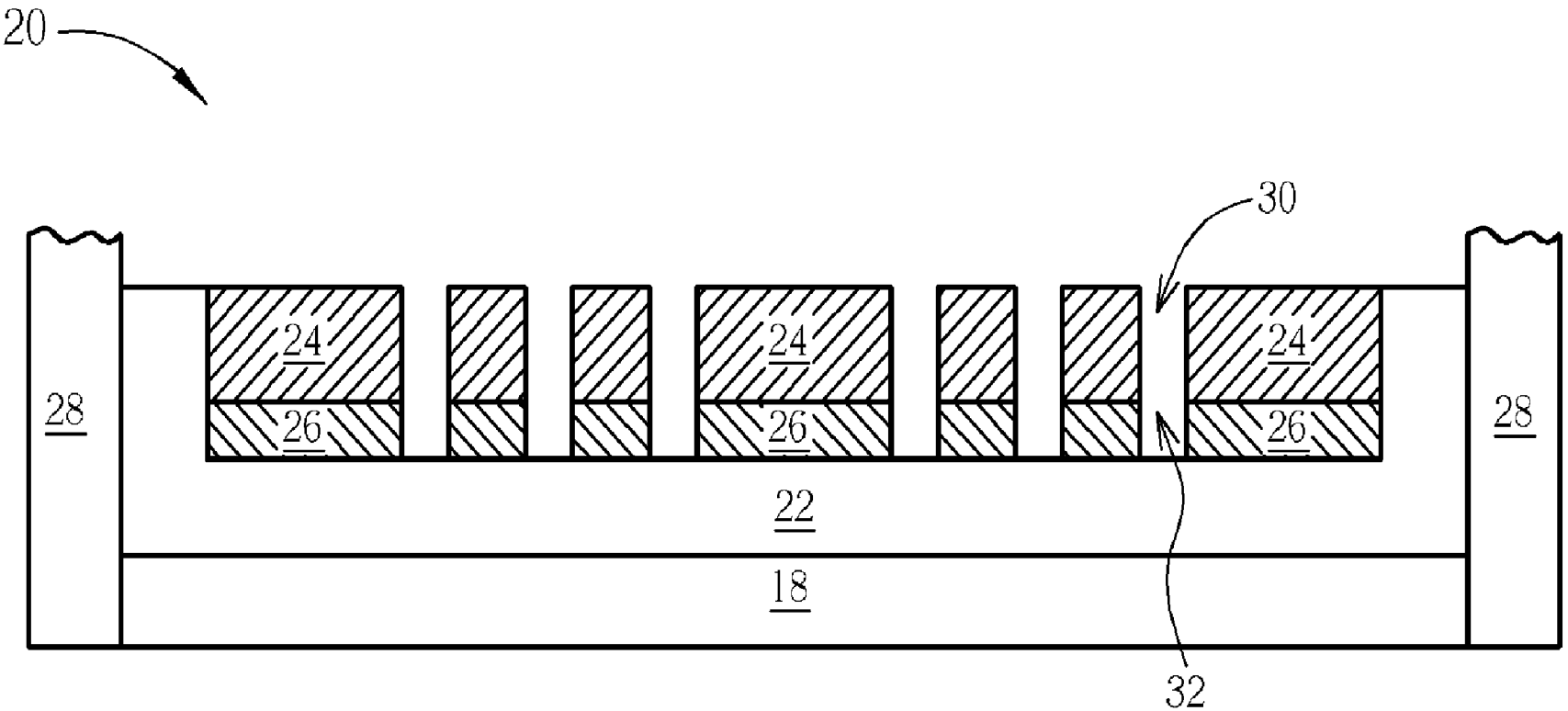
Fig. 2 Prior art
FIG. 2 illustrates a conventional CMP head.
Figure 3:
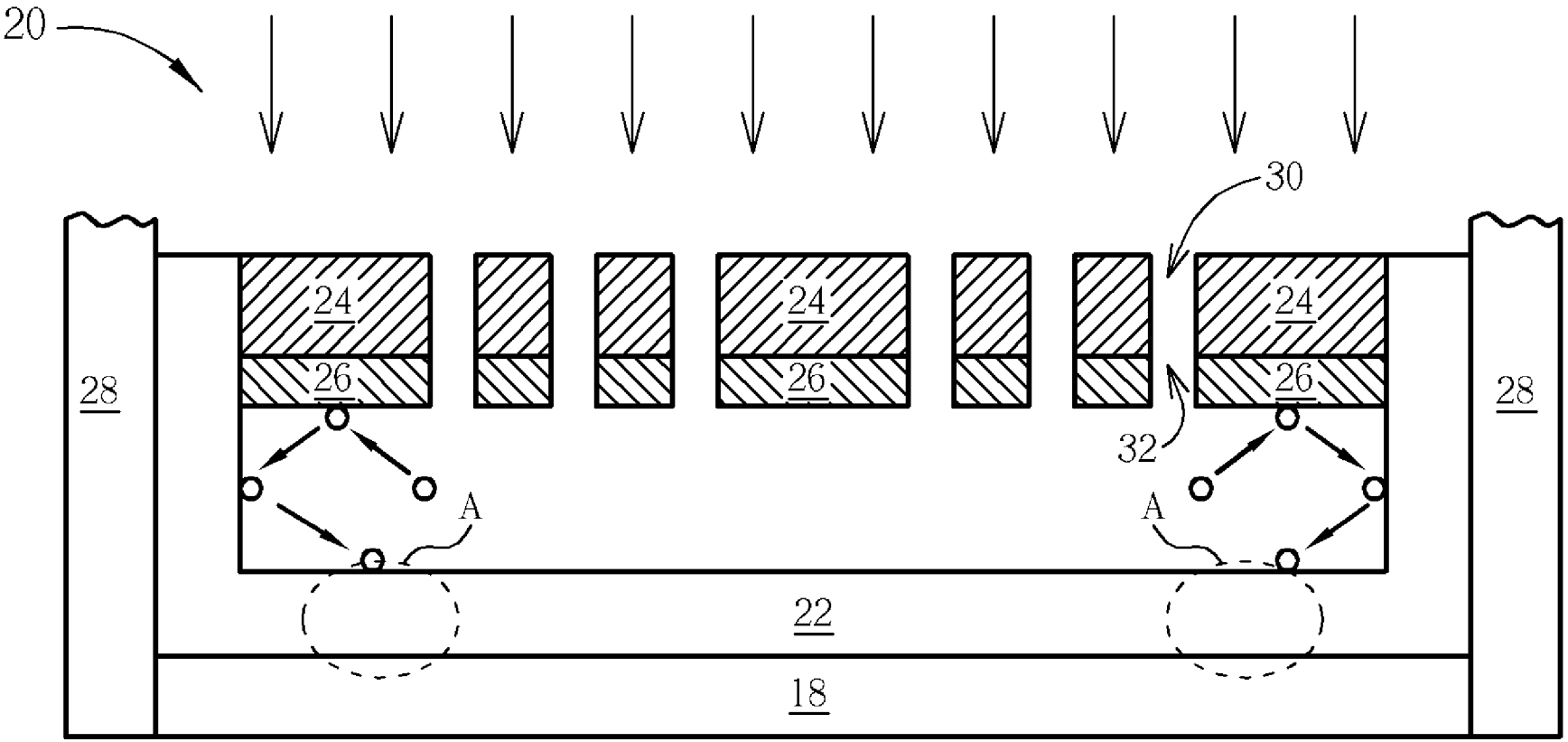
Fig. 3 Prior art
FIG. 3 illustrates the conventional CMP head during a CMP process.
Figure 4:
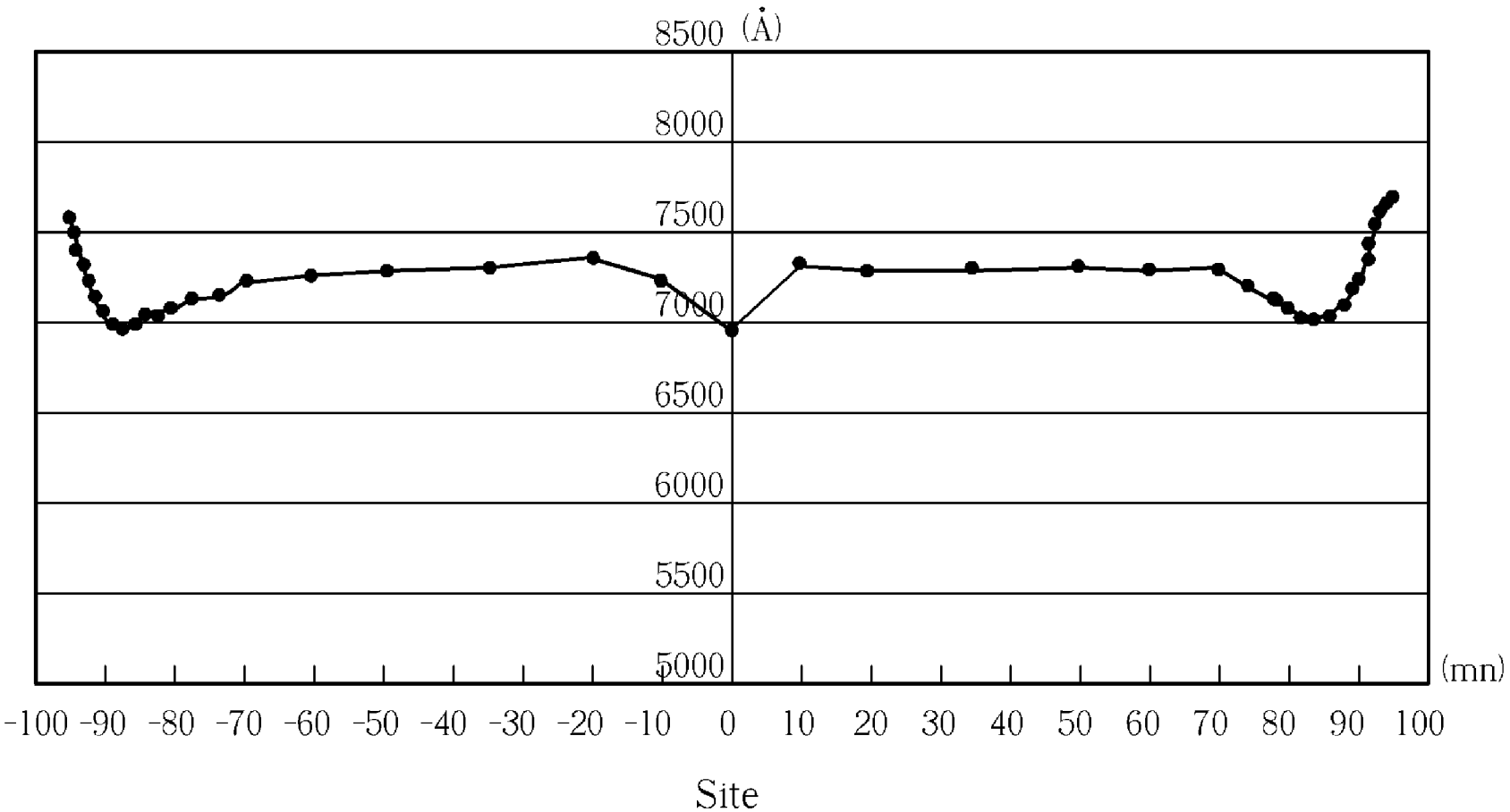
Fig. 4 Prior art
FIG. 4 illustrates a thickness distribution diagram of a material layer after CMP by using a conventional CMP head.
Figure 5:
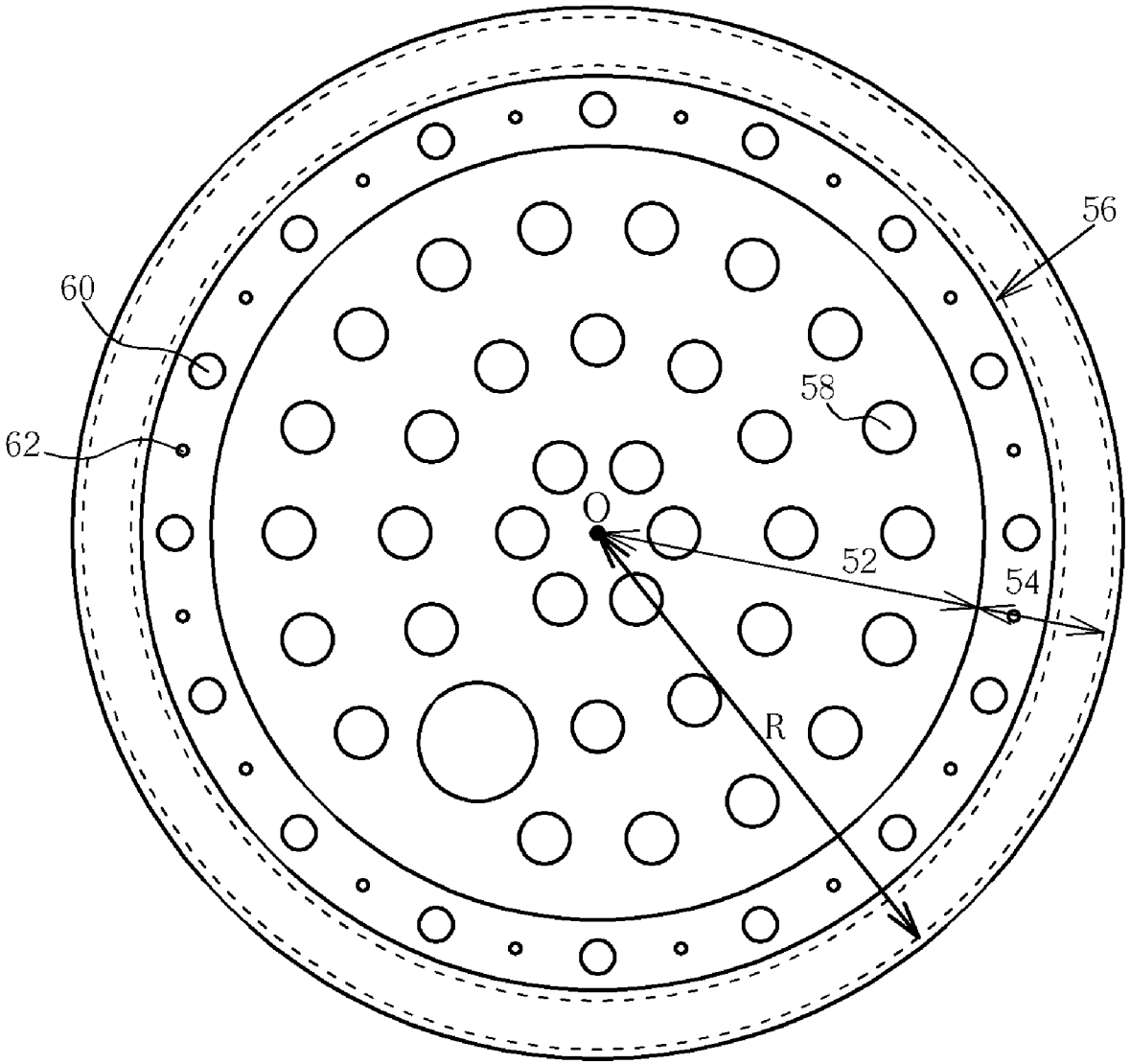
FIGS. 5-6 are schematic diagrams illustrating a CMP head according to an embodiment of the present invention.
Figure 6:
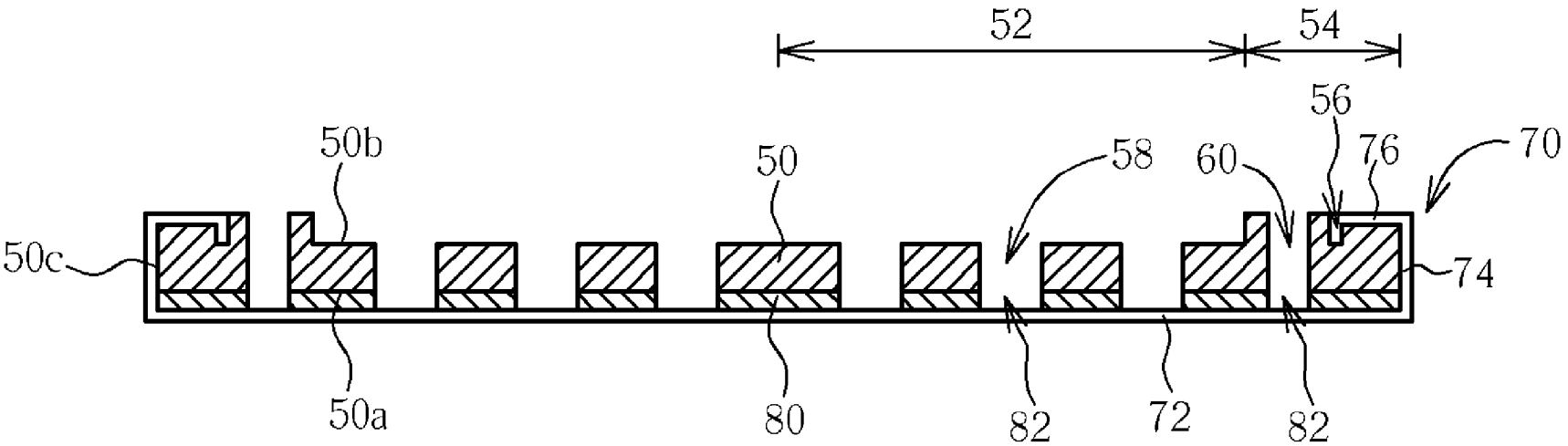

Please refer to FIGS. 5-6. FIGS. 5-6 are schematic diagrams illustrating a CMP head according to an embodiment of the present invention, where FIG. 5 is a top view and FIG. 6 is a cross-sectional view. As shown in FIGS. 5-6, the CMP head includes a membrane support 50, a membrane 70, and a support pad 80 for buffering is disposed between the membrane support 50 and the membrane 70. The membrane support 50 is substantially a disk-shaped rigid structure, having a first surface 50*a*, a second surface 50*b*, and an annular sidewall 50*c* disposed between the first surface 50*a* and the second surface 50*b*. The membrane support 50 has an origin O and a radius R, where the round region between the origin O and ⅔ R is defined as a central region 52, and the ring region between ⅔ R to R is defined as a peripheral region 54. The second surface of the membrane support 50 has a clamping groove 56 for fixing the membrane 70. The membrane support 50 further includes at least a ventilator 58, at least a diversion opening 60, and a plurality of screw holes 62. Also, the support pad 80 includes holes 82 corresponding to the ventilator 58 and the diversion opening 60. The ventilator 58 is disposed in the central region 52, while the diversion opening 60 and the screw holes 62 are disposed in the peripheral region 54. The ventilator 58 allows gas to pass through so that the membrane 70 is expanded. The diversion opening 60 is designed to alter the collision of gas molecules in the peripheral region 54 so as to prevent the fast band effect. The screw holes 62 allow screws (not shown) to screw in so that the membrane support 50 and other parts of the CMP head can be combined.

The membrane 70 is flexible, having a disk-shaped part 72 disposed on the first surface 50*a* of the membrane support 50, an annular part 74 surrounding the annular sidewall 50*c* of the membrane support 50, and a clamping flange 76 disposed on the second surface 50*b* and engaged in the clamping groove 56.

Figure 7:
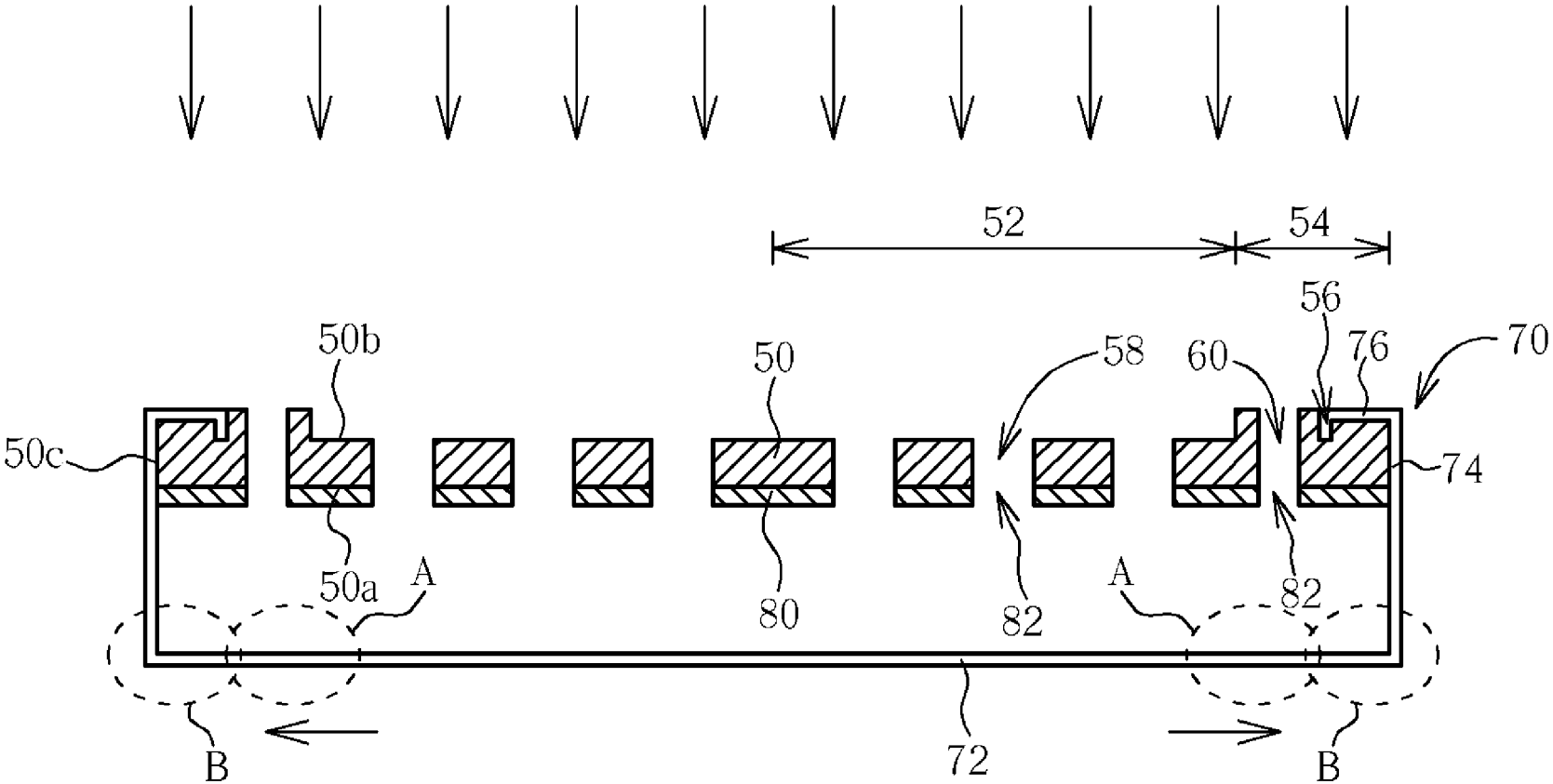
FIG. 7 is a schematic diagram illustrating the CMP head of this embodiment during a CMP process.

Please refer to FIG. 7. FIG. 7 is a schematic diagram illustrating the CMP head of this embodiment during a CMP process. As shown in FIG. 7, gas is implanted into the CMP head through the ventilator 58 and the diversion opening 60, and the membrane 70 is expanded so as to push the wafer (not shown). Accordingly, a space is formed between the membrane support 50 and the membrane 70. Due to the diversion opening 60 disposed in the peripheral region 54 of the membrane support 50, the flow path of gas is altered so that the collision of gas molecules do not focus on region A, and part of the collision of gas molecules is transferred to region B. Consequently, the pressure upon the membrane 70 is equalized, and wafer uniformity is improved in CMP.

In this embodiment, the thickness of the membrane support 50 in the peripheral region 54 is thicker than in the central region 52, and the diversion opening 60 is preferably disposed in the ring region between ¾ R and R in the peripheral region 54. In addition, the diversion opening 60 is a circular opening, and the diversion opening 60 penetrates the membrane support 50 in a direction perpendicular to the first surface 50*a*. However, the shape, dimension, location, density, penetrating direction, etc. can be modified where necessary.

Please refer to FIGS. 8-13. FIGS. 8-13 are schematic diagrams illustrating the CMP head according to different embodiments. It is appreciated that for the purpose of highlighting the differences there between, like parts are denoted by like numerals and are not redundantly described.

Figure 8:
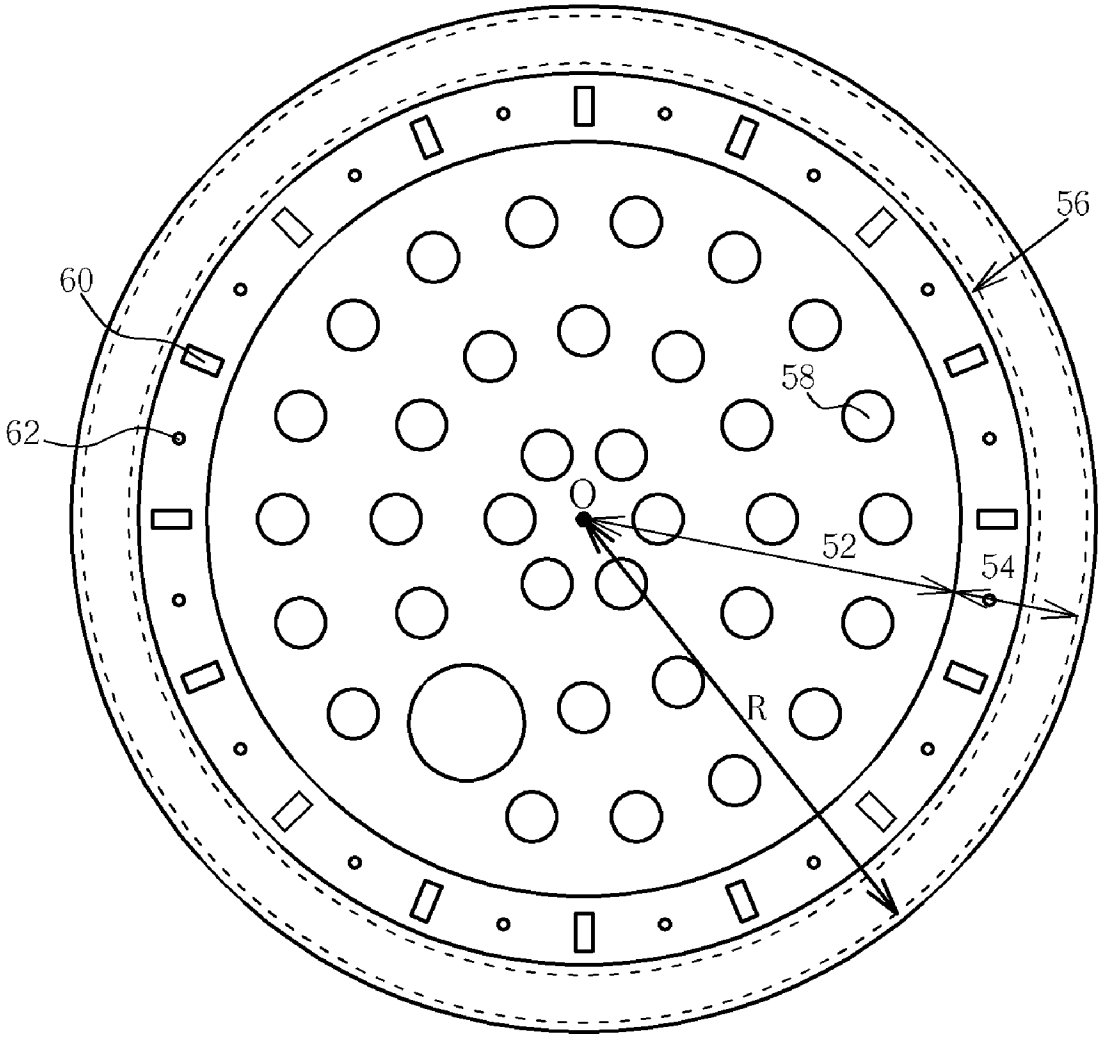
FIGS. 8-14 are schematic diagrams illustrating the CMP head according to different embodiments.
Figure 9:
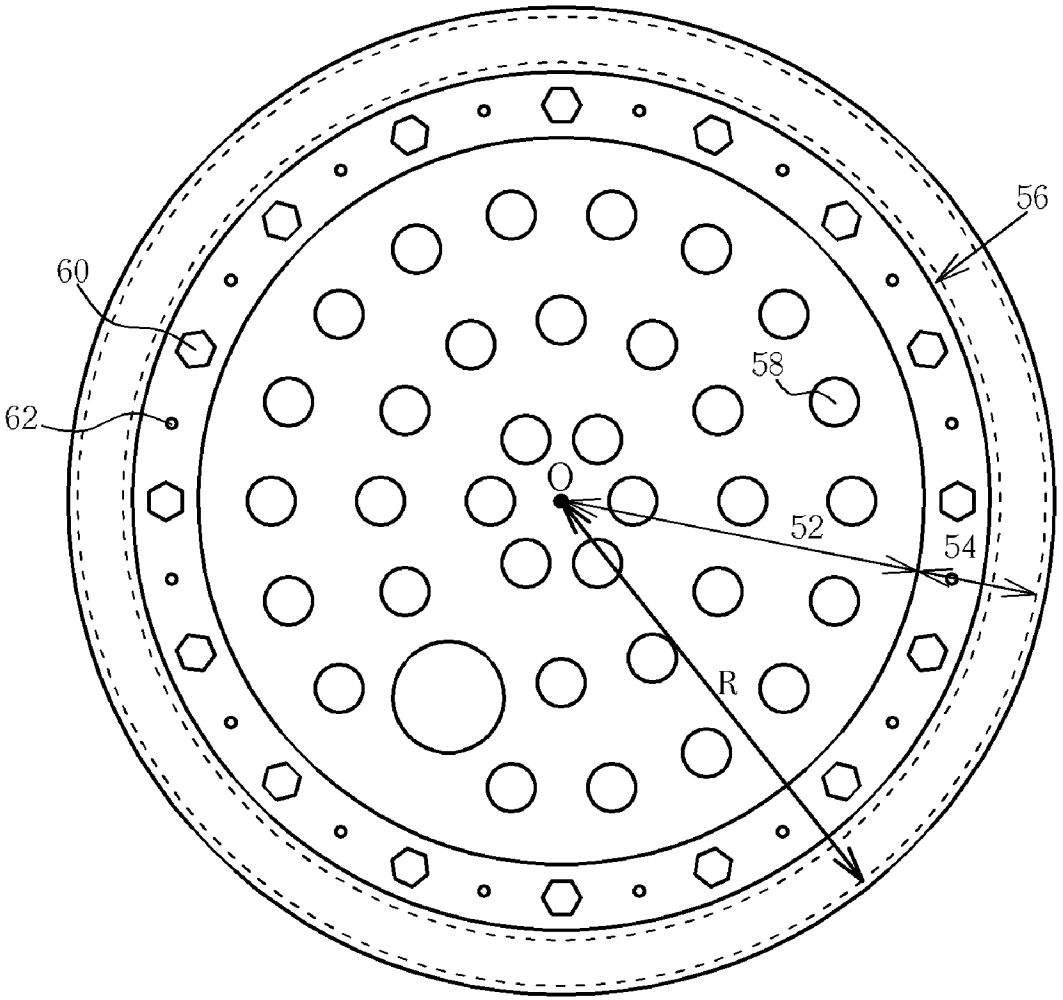

FIG. 8 and FIG. 9 illustrate the shape of the diversion opening 60 may be a slot opening, a polygonal opening e.g. hexagonal opening, or other shapes.

Figure 10:
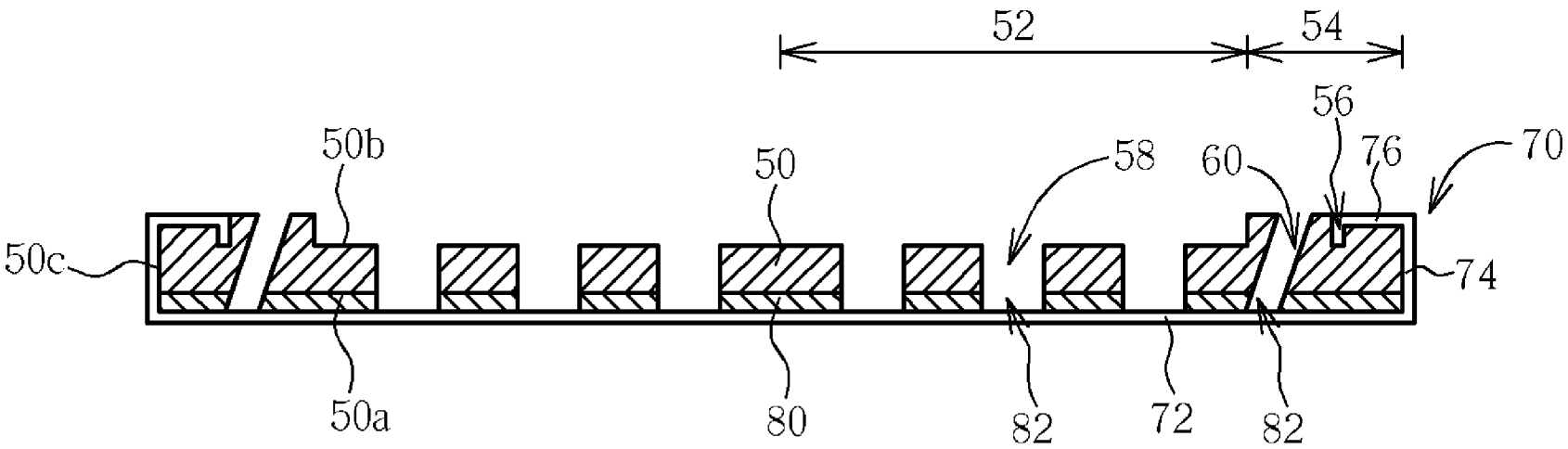

FIG. 10 shows the penetrating direction of the diversion opening 60 may not be perpendicular to the first surface 50*a*, and can be an inclined direction e.g. inwardly inclined or outwardly inclined with respect to the first surface 50*a*.

Figure 11:
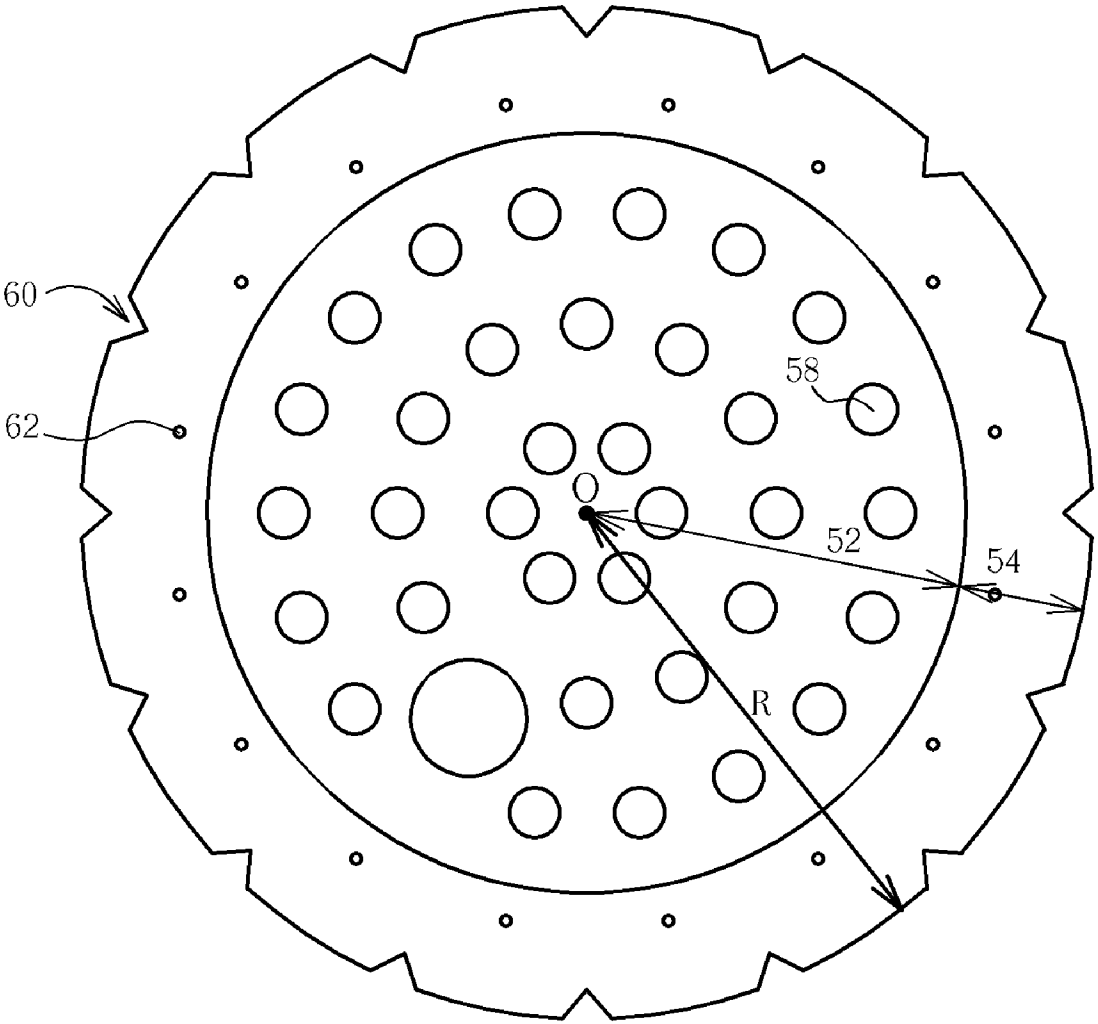
Figure 12:
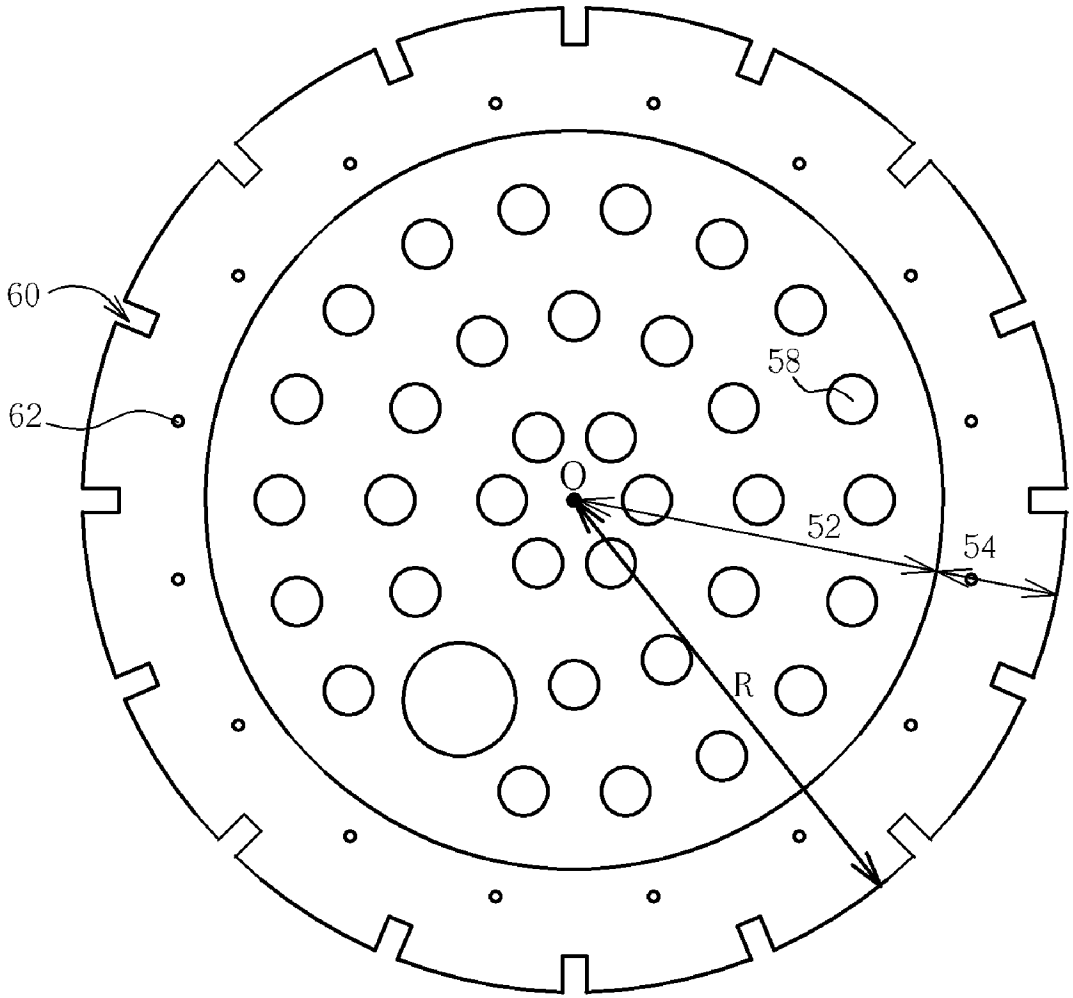

FIG. 11 and FIG. 12 illustrates the diversion opening 60 may not be a closed opening, and can be a notch disposed in the peripheral region 54 of the membrane support 50. The shape of the notch can be various shape e.g. triangular notch or rectangular notch, and these notches may form a saw tooth structure in the peripheral region 54.

Figure 13:
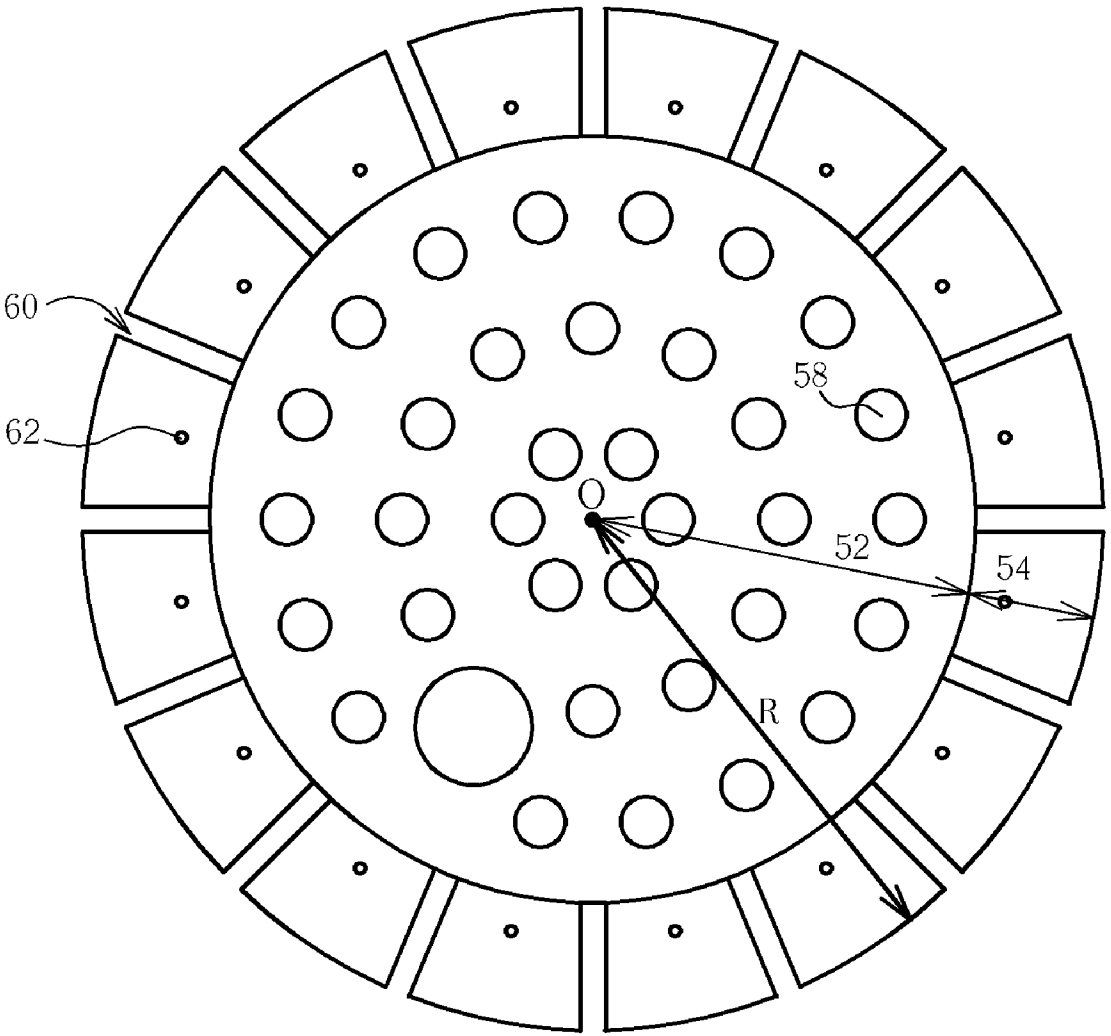

FIG. 13 depicts an embodiment similar to FIG. 12, and the difference is each diversion opening 60 is a larger notch having a deeper depth which reaches the boundary of the central region 52 and the peripheral region 54.

Figure 14:
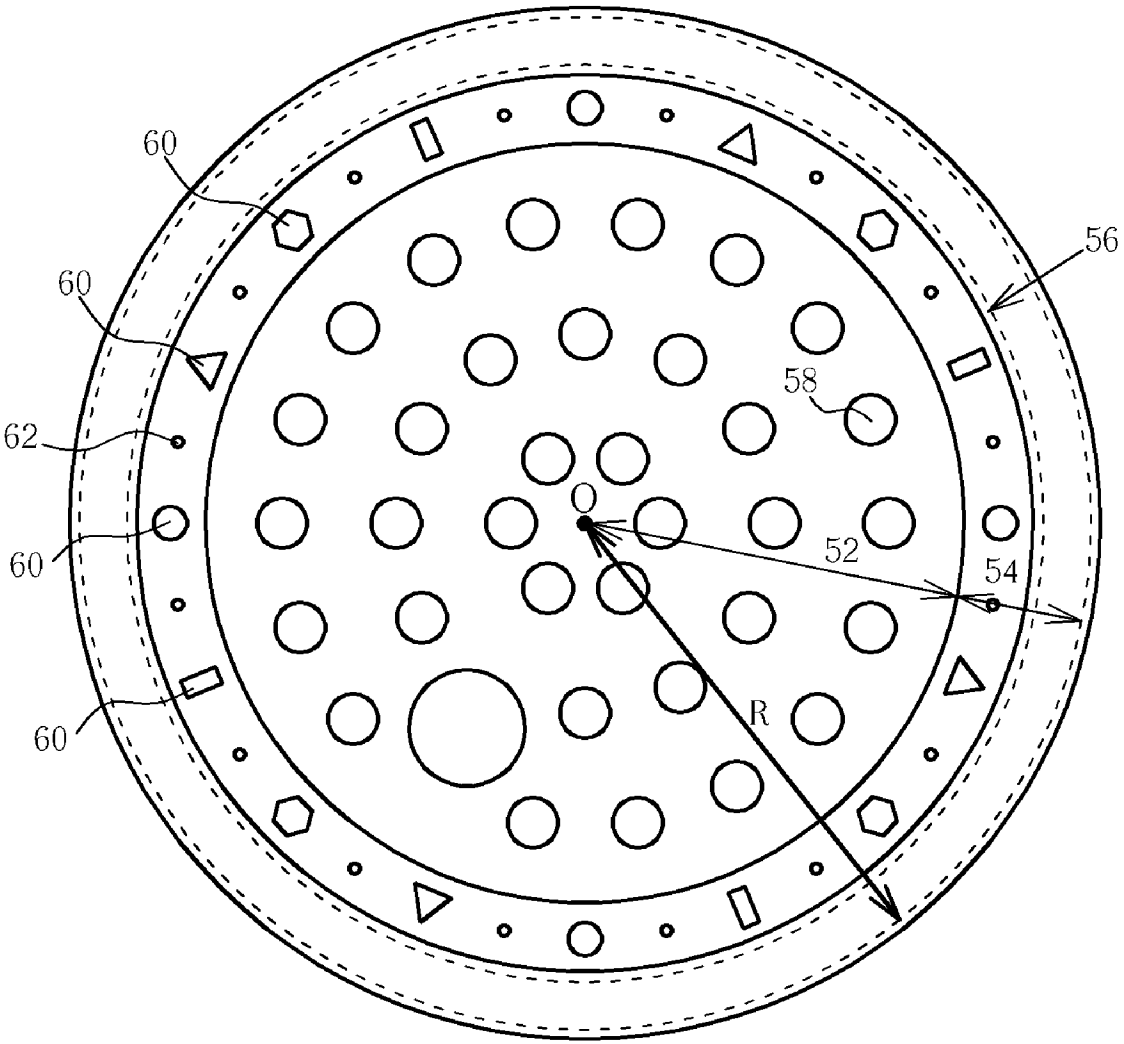

FIG. 14 shows the shapes of the diversion opening 60 may not be the same, and various types of diversion openings 60 can be used.

Figure 15:
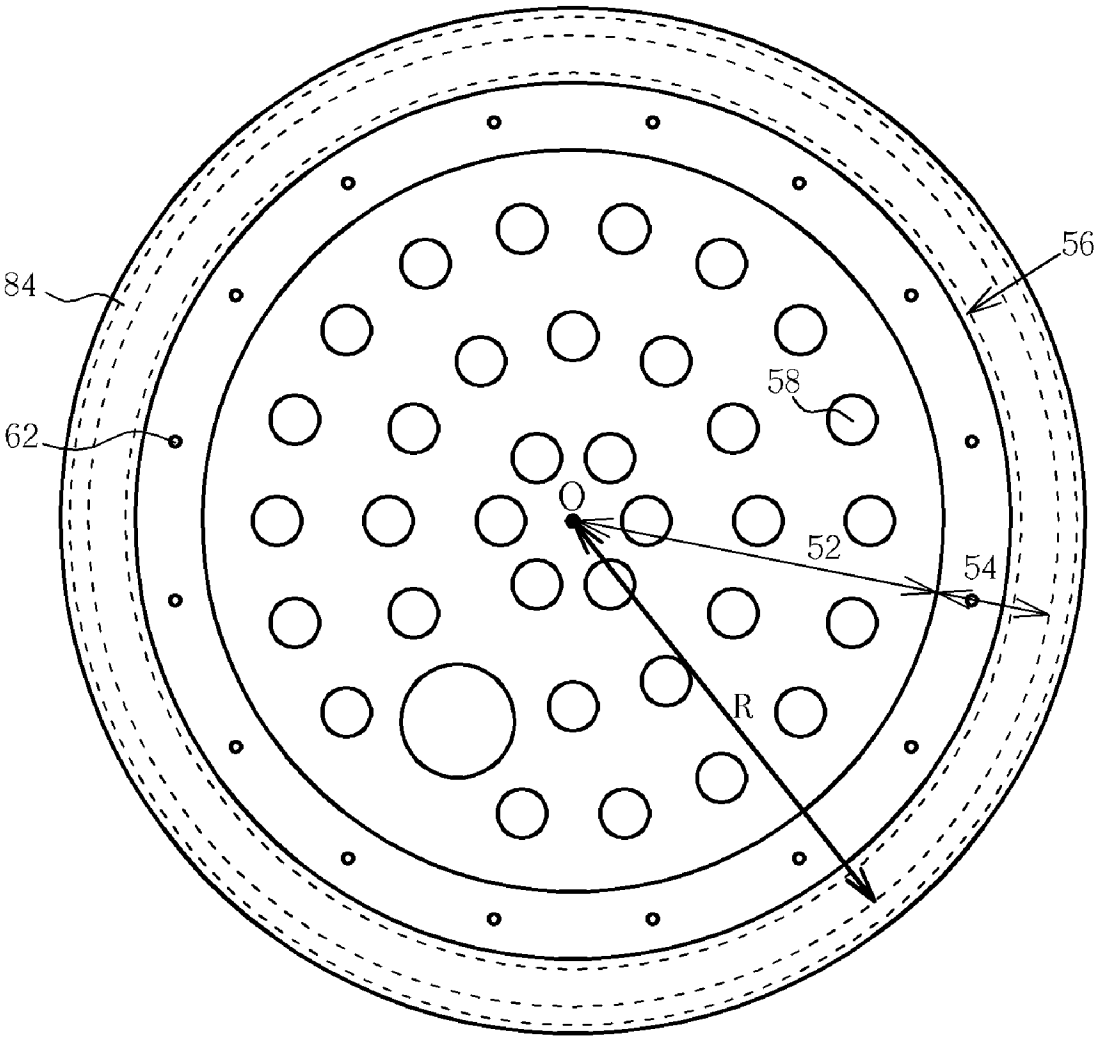
FIGS. 15-16 are schematic diagrams illustrating a CMP head of another embodiment of the present invention.
Figure 16:
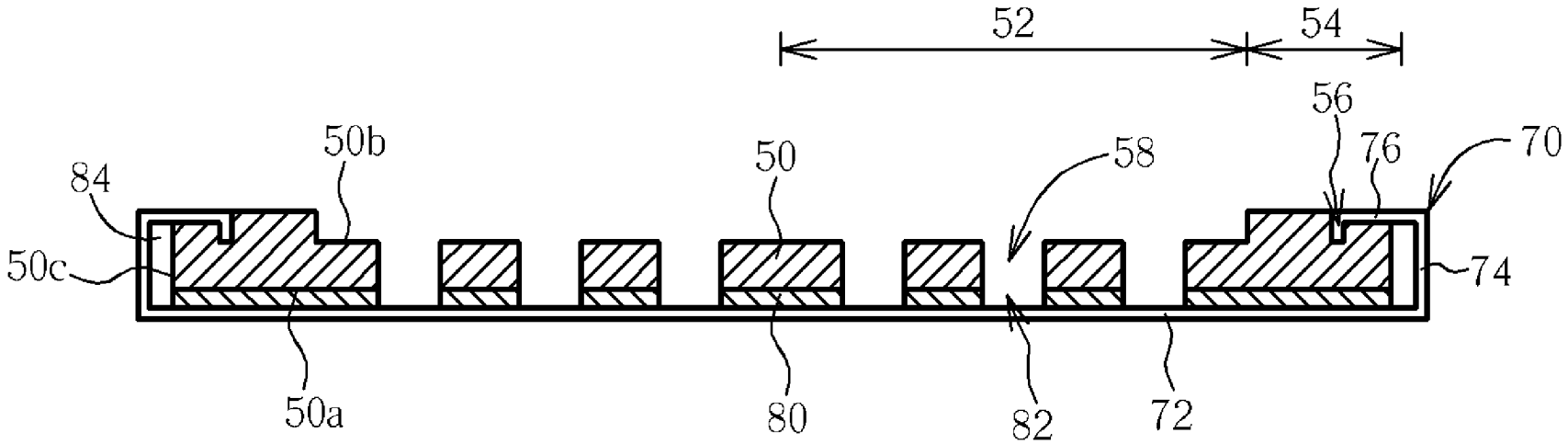

Please refer to FIGS. 15-16. FIGS. 15-16 are schematic diagrams illustrating a CMP head of another embodiment of the present invention, where FIG. 15 is a top view and FIG. 16 is a cross-sectional view. Different from the aforementioned embodiments, the CMP head of this embodiment uses a diversion space design, instead of diversion opening. The annular sidewall 50*c* of the membrane support 50 and the annular part 74 of the membrane 70 form a gap, so that the annular sidewall 50*c* and the annular part 74 are not in contact with one another. Accordingly, the annular sidewall 50*c* and the annular part 74 form a diversion space 84, which can also alter the flow path of gas molecules.

Figure 17:
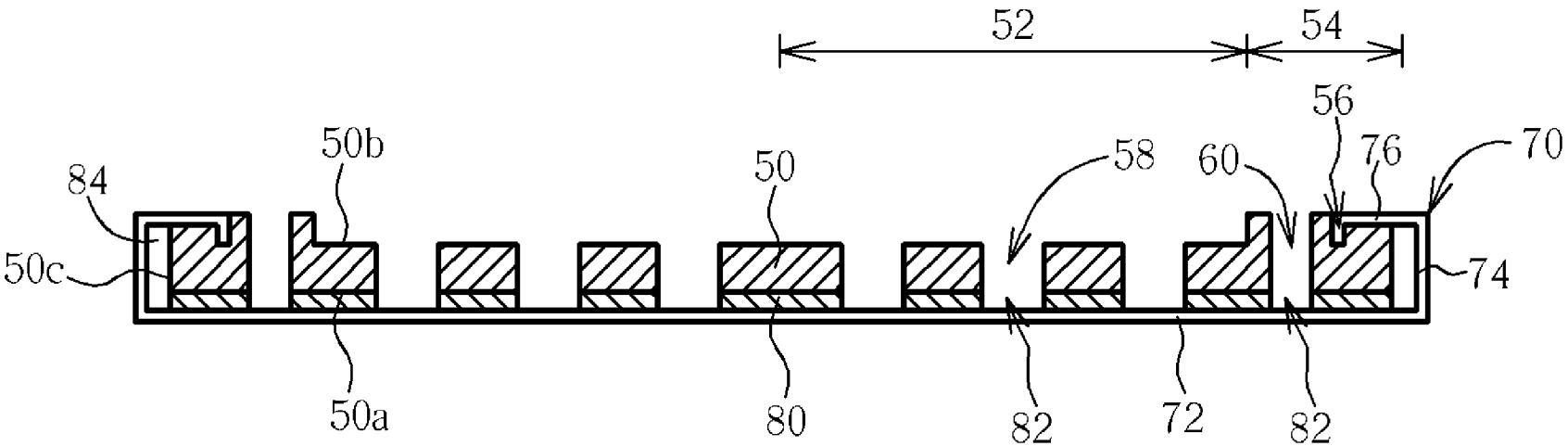
FIG. 17 is a schematic diagram of a CMP head of another embodiment.

The diversion opening design and the diversion space design are not limited to be independently applied. Please refer to FIG. 17. FIG. 17 is a schematic diagram of a CMP head of another embodiment. As shown in FIG. 17, the CMP head includes both the diversion opening 60 and the diversion space 84.

Figure 18:
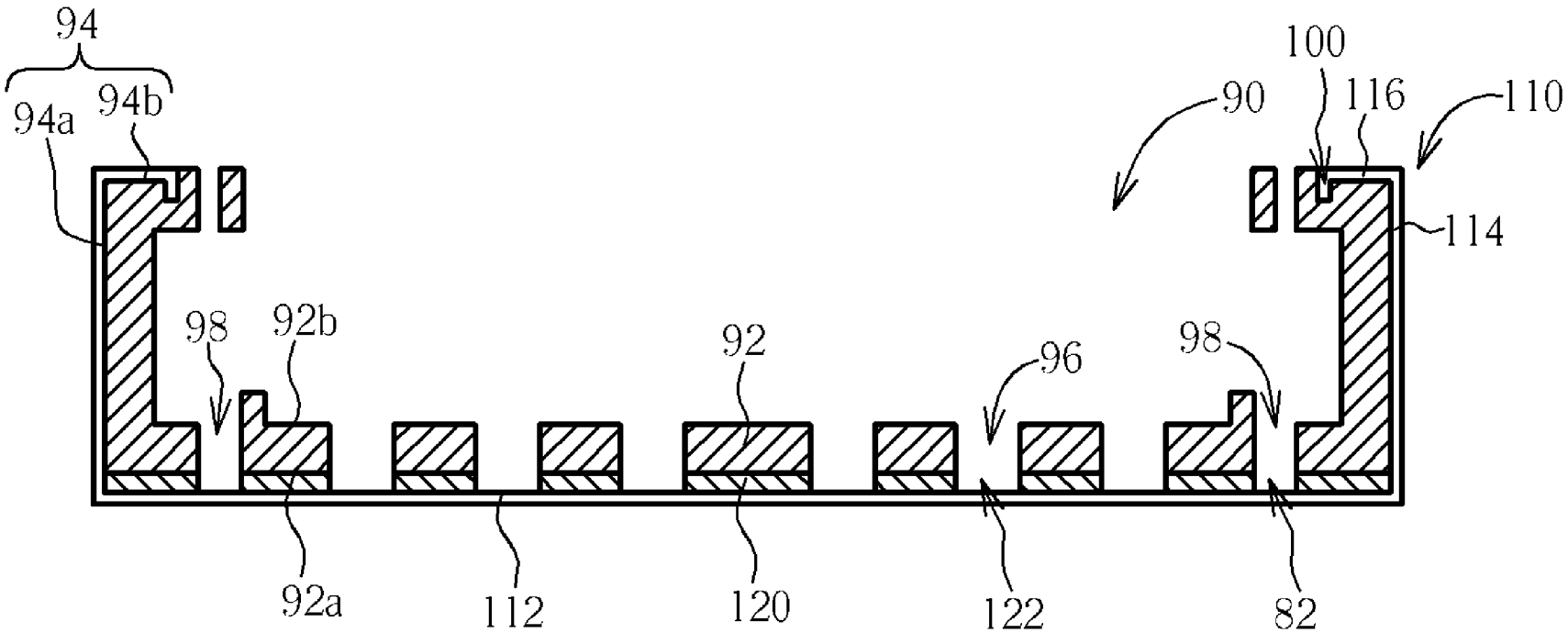
FIG. 18 is a schematic diagram of a CMP head of still another embodiment.

Please refer to FIG. 18. FIG. 18 is a schematic diagram of a CMP head of still another embodiment. As shown in FIG. 18, the CMP head includes a membrane support 90, a membrane 110, and a support pad 120 disposed between the membrane support 90 and the membrane 110. The membrane support 90 includes a support disk 92 having a first surface 92*a* and a second surface 92*b*, and a support sidewall 94 surrounding the support disk 92. The support sidewall 94 has a C-shaped cross-section having a first supporting part 94*a* structurally connected to the rim of second surface 92*b* of the support disk 92, and a second supporting part 94*b* structurally connected to the first support part 94*a*. The first supporting part 94*a* and the second surface 92*b* are substantially perpendicular. The second supporting part 94*b* is extending inwardly, and substantially parallel to the second surface 92*b*. The support disk 92 further includes at least a ventilator 96 and at least a diversion opening 98 penetrating through the support disk 92, and the diversion opening 98 is disposed in the support disk 92 somewhere corresponding to the second supporting part 94*b* of the support sidewall 94. In addition, the second supporting part 94*b* has screw holes 100, and the support pad 120 has holes 122 corresponding to the ventilator 96 and diversion opening 98.

The membrane 110 includes a disk-shaped part 112 disposed on the first surface 92*a* of the support disk 92, an annular part 114 surrounding the first supporting part 94*a* of the support sidewall 94, and a clamping part 116 clamping the support sidewall 94.

The CMP head of this embodiment includes the diversion opening 98 disposed in the support disk 92 corresponding to the second supporting part 94*b* so that gas pressure distribution is spread. It is appreciated that the shape, dimension, location, density, penetrating direction, etc. can be modified to obtain an optimized uniformity.

Figure 19:
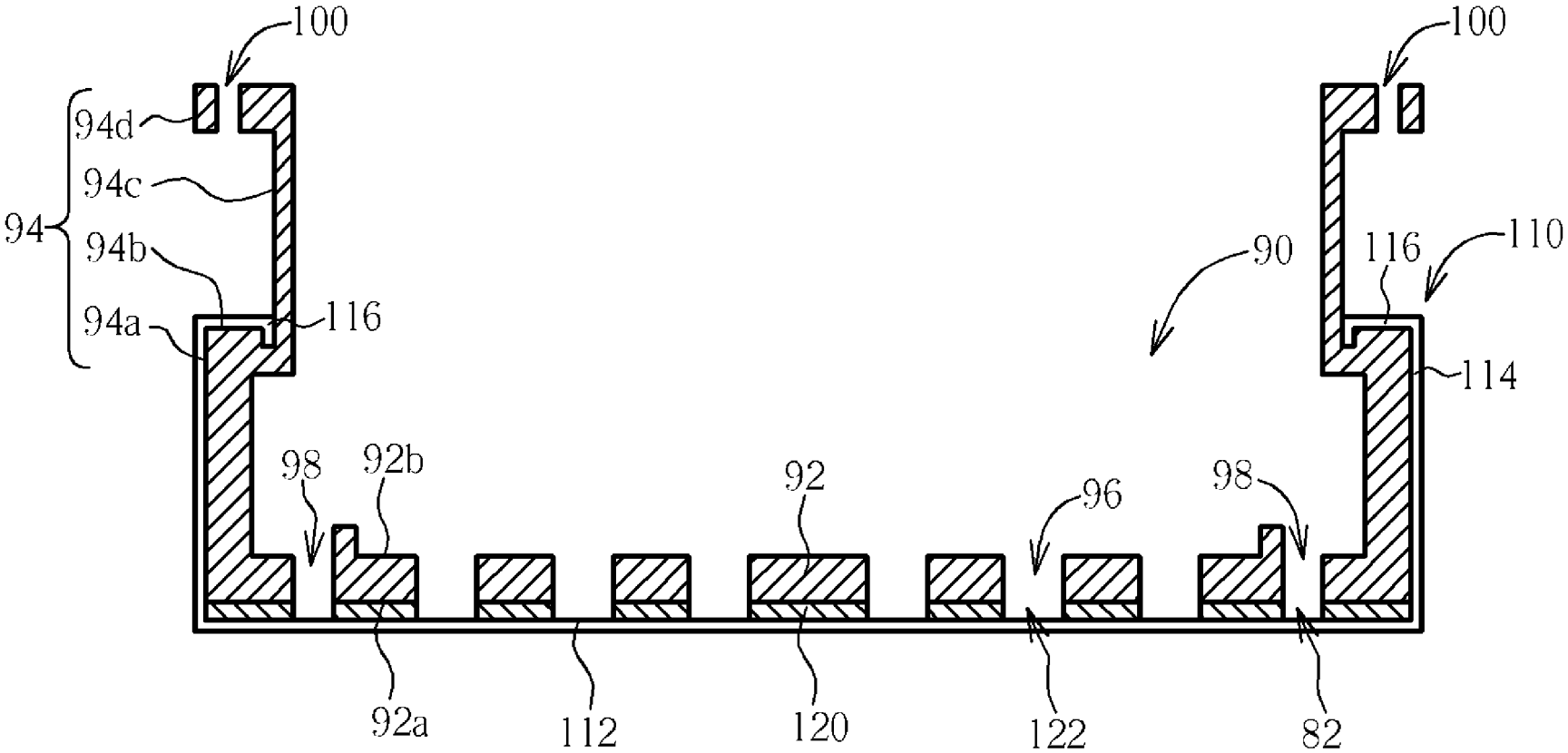
FIG. 19 is a schematic diagram illustrating another configuration of the CMP head shown in FIG. 18.

Please refer to FIG. 19. FIG. 19 is a schematic diagram illustrating another configuration of the CMP head shown in FIG. 18. As shown in FIG. 19, the support sidewall 94 further includes a third supporting part 94*c* structurally connected to the second supporting part 94*b*, and a fourth supporting part 94*d* structurally connected to the third supporting part 94*c*. The third supporting part 94*c* and the second supporting part 94*b* are substantially perpendicular, and the fourth supporting part 94*d* is extending outwardly and substantially perpendicular to the third supporting part 94*c*. In addition, the screw holes 100 are formed in the fourth supporting part 94*d*, instead of the second supporting part 94*b*.

The present invention also provides a method of forming a CMP head. Please refer to FIGS. 5-6 again. As shown in FIGS. 5-6, a membrane support 50 is provided. The membrane support 50 is disk-shaped, and has an origin O and a radius R. The membranes support 50 has a central region 52 positioned in the round region between the origin O and ⅔ R, and a peripheral region 54 disposed in the ring region between ⅔ R and R. Subsequently, at least a ventilator 58 is formed in the central region 52, and at least a diversion opening 60 is formed in the peripheral region 54. Then, a support pad 80 is bonded to a first surface 50*a* of the membrane support 50, and the membrane 70 is fixed to the membrane support 50. The membrane support 50 and the membrane 70 can be assembled with other necessary parts to form the CMP head of the present invention.

Figure 20:
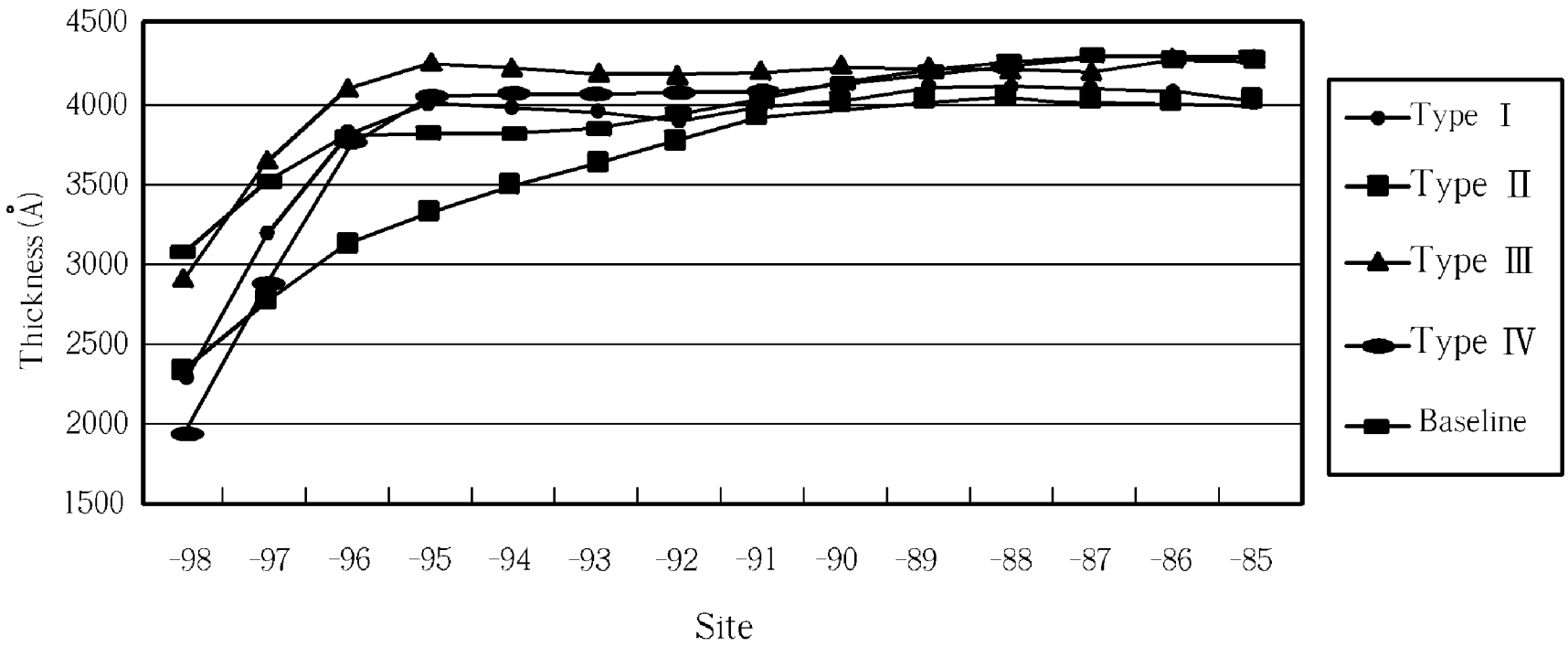
FIG. 20 illustrates a thickness distribution diagram of a material layer after CMP by using the CMP head of the present invention.

Please refer to FIG. 20. FIG. 20 illustrates a thickness distribution diagram of a material layer after CMP by using the CMP head of the present invention. In this experiment, the material layer is an oxide layer of 11,000 angstroms disposed on an 8-inch wafer, undergoing 60 seconds of CMP, and five different types of CMP head are tested. The five types of CMP heads includes:

Baseline: conventional CMP head;

Type I: CMP with 1 mm diversion space;

Type II: CMP head with diversion openings having a diameter of 3 mm in the central region;

Type III: CMP head with diversion openings having a diameter of 6 mm in the peripheral region; and Type IV: CMP head with 3 mm diversion space.

As shown in FIG. 20, Type I, Type III, and Type IV can effectively improve the thickness uniformity of the oxide layer in the peripheral region after CMP in comparison with baseline. On the other hand, Type II CMP head, in which the diversion openings are disposed in the central region rather than in the peripheral region, fails to prevent fast band effect.

In summary, the CMP head of the present invention uses diversion opening or diversion space design to improve the thickness uniformity of CMP. It is appreciated that the CMP head can be used to various CMP e.g. ILD CMP, plug CMP, STI CMP, damascene CMP, etc.

Those skilled in the art will readily observe that numerous modifications and alterations of the device and method may be made while retaining the teachings of the invention.

What is claimed is:

1. A CMP head, comprising:

a membrane support substantially being disk-shaped having a first surface, a second surface, and an annular sidewall between the first surface and the second surface, the second surface further comprising a clamping groove, the membrane support comprising at least a ventilator and at least a diversion opening, wherein the membrane support has an origin and a radius R, the membrane support comprises a central region within a round region between the origin and ⅔ R, and a peripheral region within a ring region between ⅔ R and R, the ventilator is disposed in the central region, the diversion opening is disposed in the peripheral region; and the annular part of the membrane and the annular sidewall of the membrane support form a gap so that the annular part of the membrane and the annular sidewall of the membrane support are not in contact; and a membrane supported by the membrane support, and the membrane comprises:

a disk-shaped part disposed on the first surface of the membrane support;

an annular part surrounding the annular sidewall of the membrane support; and a clamping flange engaged in the clamping groove.

2. The CMP head of claim 1, wherein the diversion opening comprises a circular opening.

3. The CMP head of claim 1, wherein the diversion opening comprises a polygonal opening.

4. The CMP head of claim 1, wherein the diversion opening comprises a slot opening.

5. The CMP head of claim 1, wherein the diversion opening comprises a notch disposed in a rim of the peripheral region.

6. The CMP head of claim 1, wherein the diversion opening penetrates the membrane support.

7. The CMP head of claim 6, wherein the diversion opening penetrates the membrane support in a direction perpendicular to the first surface.

8. The CMP head of claim 6, wherein the diversion opening penetrates the membrane support in an inclined direction with respect to the first surface.

9. The CMP head of claim 1, wherein the diversion opening is disposed with a ring region between ¾ R and R.

10. The CMP head of claim 1, further comprising a plurality of diversion openings disposed in the peripheral region, and the diversion openings have different shapes.

11. The CMP head of claim 1, further comprising a plurality of screw holes in the peripheral region.

12. The CMP head of claim 1, further comprising a support pad disposed between the membrane support and the membrane, and the support pad comprising a plurality of holes corresponding to the ventilator and the diversion opening.

13. The CMP head of claim 1, wherein the membrane support is thicker in the peripheral region than in the central region.

14. A CMP head, comprising:

a membrane support adapted to support a membrane, the membrane support substantially being disk-shaped having a first surface, a second surface, and an annular sidewall between the first surface and the second surface, the membrane support comprising at least a ventilator, at least a diversion opening, and a plurality of screw holes, wherein the membrane support comprises a central region and a peripheral region, the ventilator is disposed in the central region, the diversion opening and the screw holes are disposed in the peripheral region, and the membrane support is thicker in the peripheral region than in the central region;

a membrane comprising, a disk-shaped part disposed on the first surface of the membrane support;

an annular part surrounding the annular sidewall of the membrane support; and a clamping flange;

wherein the second surface further comprises a clamping groove, the clamping flange is engaged in the clamping groove, and the annular part of the membrane and the annular sidewall of the membrane support form a gap so that the annular part of the membrane and the annular sidewall of the membrane support are not in contact;

a support pad disposed between the membrane support and the membrane, and the support pad comprising a plurality of holes corresponding to the ventilator and the diversion opening.

15. The CMP head of claim 14, wherein the diversion opening comprises a circular opening.

16. The CMP head of claim 14, wherein the diversion opening comprises a polygonal opening.

17. The CMP head of claim 14, wherein the diversion opening comprises a slot opening.

18. The CMP head of claim 14, wherein the diversion opening comprises a notch disposed in a rim of the peripheral region.

19. The CMP head of claim 14, wherein the diversion opening penetrates the membrane support.

20. The CMP head of claim 19, wherein the diversion opening penetrates the membrane support in an direction perpendicular to the first surface.

21. The CMP head of claim 19, wherein the diversion opening penetrates the membrane support in an inclined direction with respect to the first surface.

22. The CMP head of claim 14, further comprising a plurality of diversion openings disposed in the peripheral region, and the diversion openings have different shapes.

23. A CMP head, comprising:

a membrane support comprising:

a support disk having a first surface and a second surface; and a support sidewall surrounding the support disk, the support sidewall having a C-shaped cross-section comprising a first supporting part structurally connected to a rim of the second surface of the support disk and substantially perpendicular to the second surface, and a second supporting part structurally connected to the first supporting part, the second supporting part extending inwardly and substantially parallel to the second surface, wherein the support disk further comprises at least a ventilator and at least a diversion opening penetrating the support disk, and the diversion opening is disposed corresponding to the second supporting part of the support sidewall; and a membrane supported by the membrane support.

24. The CMP head of claim 23, wherein the diversion opening comprises a circular opening.

25. The CMP head of claim 23, wherein the diversion opening comprises a polygonal opening.

26. The CMP head of claim 23, wherein the diversion opening comprises a slot opening.

27. The CMP head of claim 23, wherein the diversion opening penetrates the support disk in a direction perpendicular to the first surface.

28. The CMP head of claim 23, wherein the diversion opening penetrates the support disk in an inclined direction with respect to the first surface.

29. The CMP head of claim 23, wherein the support disk further comprising a plurality of diversion openings corresponding to the second supporting part of the support sidewall, and the diversion openings have different shapes.

30. The CMP head of claim 23, further comprising a plurality of screw holes disposed in the second supporting part of the support sidewall.

31. The CMP head of claim 23, wherein the support sidewall further comprises a third supporting part structurally connected to the second supporting part and substantially perpendicular to the second supporting part, and a fourth supporting part structurally connected to the third supporting part, the fourth supporting part extending outwardly and substantially perpendicular to the third supporting part.

32. The CMP head of claim 31, further comprising a plurality of screw holes disposed in the fourth supporting part of the support sidewall.

33. The CMP head of claim 23, wherein the membrane comprises:

a disk-shaped part disposed on the first surface of the support disk;

an annular part surrounding the first supporting part of the support sidewall; and a clamping part clamping the support sidewall.

34. The CMP head of claim 23, further comprising a support pad disposed between the membrane support and the membrane, and the support pad comprising a plurality of holes corresponding to the ventilator and the diversion opening.

35. A CMP head, comprising:

a membrane support substantially being disk-shaped having a first surface, a second surface, and an annular sidewall between the first surface and the second surface, and a membrane comprising:

a disk-shaped part disposed on the first surface of the membrane support; and an annular part surrounding the annular sidewall of the membrane support;

wherein the second surface further comprises a clamping groove, the membrane further comprises a clamping flange engaged in the clamping groove, and the annular part of the membrane and the annular sidewall of the membrane support form a gap so that the annular part of the membrane and the annular sidewall of the membrane support are not in contact.

* * * * *